United States Patent [19]

Beale, Jr.

[11] 4,073,704

[45] Feb. 14, 1978

[54] METHOD FOR MAGNESIUM PRODUCTION USING TUNGSTEN OR MOLYBDENUM

[75] Inventor: Alvin Francis Beale, Jr., Lake Jackson, Tex.

[73] Assignee: The Dow Chemical Company, Midland, Mich.

[21] Appl. No.: 739,768

[22] Filed: Nov. 8, 1976

[51] Int. Cl.[2] ..... C25C 5/04; C25C 3/04

[52] U.S. Cl. ..... 204/70

[58] Field of Search ..... 204/70, 71

[56] References Cited

U.S. PATENT DOCUMENTS

| | | | |
|---|---|---|---|
| 1,833,425 | 11/1931 | Jessup | 204/70 |
| 3,565,917 | 2/1971 | Cervenka et al. | 204/70 |

*Primary Examiner*—John H. Mack
*Assistant Examiner*—H. A. Feeley
*Attorney, Agent, or Firm*—Benjamin G. Colley

[57] ABSTRACT

A process for the production of metallic magnesium wherein a molten salt bath containing sodium chloride, magnesium chloride, potassium chloride, calcium chloride and magnesium fluoride is electrolytically decomposed with a cathode and an anode and wherein there is added periodically inorganic salts of molybdenum or tungsten, metallic molybdenum or tungsten, or mixtures thereof in sufficient amounts to coat the cathode surface with molybdenum or tungsten and thereby increase the recovery of magnesium.

The advantage of the process is that less sludge is formed and of the sludge that is formed there is less magnesium entrapped therein. A further advantage is that the magnesium is produced with a higher cell efficiency.

8 Claims, No Drawings

METHOD FOR MAGNESIUM PRODUCTION USING TUNGSTEN OR MOLYBDENUM

BACKGROUND OF THE INVENTION

The process of this invention relates to a process for the production of metallic magnesium by electrolytically decomposing a molten salt bath containing magnesium chloride with the periodic addition of inorganic salts of molybdenum, or tungsten, metallic molybdenum or tungsten, or mixtures thereof.

It is known from Cervenka, et al., U.S. Pat. No. 3,565,917 that vanadium compounds when added to electrolytic magnesium cells result in increased current or cell efficiencies. However, the use of these additives has the disadvantage that vanadium rapidly volatilizes out of the exhaust vents and/or dissipates into the sludge which is accumulated in these cells and must be removed periodically.

SUMMARY OF THE INVENTION

It now has been discovered that magnesium can be produced by an improved process wherein magnesium chloride is electrolytically decomposed in a molten salt bath comprising an alkali metal chloride or mixtures thereof. The essential steps in the process are as follows:

A. heating and fusing the salt bath at a temperature in the range from about 660° to about 900° C., B. passing direct current through said bath to decompose the magnesium chloride, C. maintaining a concentration of magnesium chloride in the salt bath in the range from about 5 to about 35 percent by weight by periodic additions thereof, D. adding periodically to the salt bath sufficient amounts of an additive selected from the group consisting of inorganic salts of molybdenum, inorganic salts of tungsten, metallic molybdenum, metallic tungsten, or mixtures thereof which will coat the cathode surface with said metal and thereby increase the agglomeration of molten magnesium, and E. recovering molten magnesium from said salt bath.

Generally, about 100 to about 1000 parts per million of the additive is added periodically to the salt bath.

The advantage of this invention is that the cell efficiency is increased since the molybdenum and/or tungsten additive appears to result in a coating of the cathode with a thin coat of the corresponding metal. This coating which is generally less than 15 angstroms promotes the wetting of the cathode with magnesium. This in turn results in the liberation of relatively large globules of magnesium which separate from the bath for recovery. This is in contrast to the prior art methods wherein relatively larger amounts of magnesium were lost in the sludge since the relatively finer droplets of magnesium produced at the cathode did not properly coalesce and separate from the molten bath as a separate phase of molten magnesium.

DETAILED DESCRIPTION

The process of this invention was carried out in an experimental cell wherein a steel cylindrical container having a cover plate was wrapped with electrical heating wires. The cover plate had openings therein for a graphite rod which was suspended in the center therefrom into the salt bath to act as the anode. A steel cathode in the form of a ring was mounted directly to and near the bottom of the container with the anode located in the center thereof. Vicor or high silica glass tubes were provided to supply an argon gas blanket over the molten salt bath and to remove chlorine gas from the area between the steel cathode ring and central anode.

The temperature of the bath was measured with a chromel-alumel thermocouple. The direct current power was applied by means of a Powermate DC power supply to the electrodes. The heat to the heating wires was controlled manually by means of autotransformers. The magnesium chloride concentration in the bath was maintained by means of an automatic feeder which introduced predetermined amounts of feed into the cell at regular intervals.

The process of this invention is equally useful in magnesium cells in which the molten magnesium floats to the surface as well as in lithium cells as illustrated by U.S. Pat. No. 2,950,236 wherein the magnesium sinks to bottom of the bath.

In general the temperature range of the salt bath used herein ranges from about 660° to about 900° C with the preferred range being from about 670° to about 750° C.

The magnesium chloride is added to the molten bath so as to maintain a concentration in the range from about 5 to about 35 weight percent with a preferred range being from about 10 to about 20 weight percent.

The inorganic salts of molybdenum and tungsten which are useful in this invention are generally those which have a low volatility at the above temperature ranges and which have a high percentage of metal contained therein. Less preferred but still useful are more volatile compounds.

The above metals in metallic form can be used if in a finely divided form i.e. generally less than 20 mesh size.

Examples of useful salts of molybdenum are molybdenum oxides such as the di, tri and sesqui oxides; the molybdenum halides such as $MoCl_3$; the ammonium, alkali metal, and alkaline earth metal molybdates such as $Na_2MoO_4$, $(NH_4)_2MoO_4$, $K_2Mo_4O_{13}$, $CaMoO_4$ and the like or mixtures of the same.

Examples of useful salts of tungsten are tungsten oxides such as the di, tri and pentoxides; the tungsten oxyhalides such as $WO_2Br_2$, $WOCl_4$, and $WOF_4$; the tungsten halides such as $WCl_6$, $WCl_2$, $WF_6$; the ammonium, alkali metal and alkaline earth metal tungstates such as $(NH_4)_2WO_4$, $Na_2WO_4$, $Li_2WO_4$, $BaWO_4$, and the like or mixtures of the same.

Salts of molybdenum and tungsten with heavy metals such as nickel, copper, iron, zinc and non-metals such as silicon, boron, and arsenic are to be avoided since they either increase the sludge problem or create undesirable alloys with the magnesium.

It has been found that the above metals or the inorganic salts thereof will give a coating of tungsten or molybdenum on the cathode generally less than about 15 angstroms and in the range from about 1.5 to about 10 angstroms.

It has been further found that the above metal coating causes a wetting of cathode surface by the magnesium with the contact angle being less than 10°. This is most unusual since the other element in Group VIB of the periodic table, chromium, does not have this effect and in fact its effect is adverse to the production of magnesium as is seen by control II hereinafter.

Bath Compositions and Materials

The compositions of the salt baths used herein are

| | Bath I | Bath II |
|---|---|---|
| NaCl | 56% | 53% |
| KCl | 15% 18% | |
| $CaCl_2$ | 12% | 12% |
| $CaF_2$ | 1% | 1% |
| $MgCl_2$ | 15% | 15% |
| MgO | 1% | 1% |

Reagent grade sodium, potassium, and calcium chlorides and calcium fluoride were used for the bath. The magnesium chloride used was about 96% pure, the chief contaminants being sodium, potassium, and calcium chlorides and magnesium oxide, hydroxychloride, and oxychloride.

Control I

5200 Grams of bath I were melted and the temperature was brought up to 700° C. Eight amperes of direct current were applied to the cell. Cell feed containing approximately 96% magnesium chloride was fed at a rate of about 320 gms per day. The bath was dipped daily to remove the produced magnesium. The metal was washed with cold water and dried before weighing. The bath was analyzed twice a week for all major constituents except calcium fluoride which was analyzed weekly. When the analysis indicated the bath composition had changed, additions were made and the rate of feed addition altered to maintain a relatively constant composition.

The cell was run for 13 days. On the 14th day the cell efficiency was averaged and reported as in Table I as day #1. This was repeated for 39 more days to eliminate the day to day variations. The overall average for the 14 days averages was 75.34%.

TABLE I

| | | | | (no additive) | | | | | |
|---|---|---|---|---|---|---|---|---|---|
| Day | Mg Prod. (gms) | Cell Efficiency (%) | Cell Eff. 14 Day Average (%) | Sludge (gms) | Day | Mg Prod. (gms) | Cell Efficiency (%) | Cell Eff. 14 Day Average (%) | Sludge (gms) |
| 1 | 56.0 | 64.4 | 60.3 | N.A. | 11 | 62.4 | 84.9 | 71.7 | N.A. |
| 2 | 63.0 | 72.4 | 64.9 | 149 | 12 | 61.9 | 71.1 | 71.5 | N.A. |
| 3 | 65.4 | 75.1 | 67.5 | N.A. | 13 | 45.1 | 51.8 | 69.7 | N.A. |
| 4 | 61.0 | 70.1 | 68.1 | 225 | 14 | 58.1 | 66.8 | 69.9 | 182 |
| 5 | 65.1 | 74.8 | 70.8 | N.A. | 15 | 55.6 | 63.9 | 69.2 | 200 |
| 6 | 65.3 | 75.0 | 68.3 | N.A. | 16 | 64.5 | 74.1 | 70.0 | 50 |
| 7 | 59.6 | 68.5 | 68.2 | N.A. | 17 | 63.8 | 73.3 | 70.2 | 75 |
| 8 | 67.4 | 77.4 | 69.0 | 155 | 18 | 66.4 | 76.3 | 70.3 | 26 |
| 9 | 68.0 | 78.2 | 69.8 | N.A. | 19 | 78.0 | 89.7 | 71.3 | 62 |
| 10 | 73.9 | 84.9 | 71.2 | N.A. | 20 | 68.9 | 79.1 | 72.1 | 62 |
| 21 | 68.9 | 79.1 | 72.1 | 62 | 31 | 73.0 | 83.9 | 80.6 | 25 |
| 22 | 73.4 | 84.4 | 71.9 | 60 | 32 | 74.5 | 85.6 | 80.3 | 35 |
| 23 | 73.0 | 83.9 | 71.9 | N.A. | 33 | 73.0 | 83.9 | 80.6 | 45 |
| 24 | 73.3 | 84.2 | 72.8 | N.A. | 34 | 74.0 | 85.0 | 81.8 | N.A. |
| 25 | 74.9 | 86.1 | 73.8 | 25 | 35 | 69.8 | 80.2 | 81.5 | 82 |
| 26 | 76.3 | 87.7 | 76.4 | N.A. | 36 | 65.7 | 75.5 | 80.9 | N.A. |
| 27 | 75.4 | 86.7 | 77.8 | N.A. | 37 | 72.9 | 83.8 | 80.9 | N.A. |
| 28 | 70.1 | 80.5 | 79.0 | N.A. | 38 | 68.8 | 79.1 | 80.4 | N.A. |
| 29 | 66.3 | 76.2 | 79.1 | N.A. | 39 | 121.0 | 69.5 | 77.8 | 60 |
| 30 | 74.4 | 85.5 | 80.0 | 20 | | | | | |

EXAMPLE I 5200 gms of bath I were melted and the temperature was brought to 700° C. Eight amperes of direct current were applied to the cell. Cell feed containing about 96% magnesium chloride was fed at a rate of about 320 gms per day. The bath was analyzed as in Control I. The metal was dipped daily.

In this experiment, 2 gms of molybdenum trioxide were added to the bath at start-up. Another 1 gm was added every 7 days. The dates of all additions are marked with an asterisk in Table II.

The data in Table II indicates the overall average for the 14 day averages was 79.73%. A significant increase over Control I.

TABLE II

| Day | Mg. Prod. (gms) | Cell Efficency (%) | Cell Eff. 14 Day Average (%) | Sludge (gms) | Day | Mg. Prod. (gms) | Cell Efficiency (%) | Cell Eff. 14 Day Average (%) | Sludge (gms) |
|---|---|---|---|---|---|---|---|---|---|
| 1* | 71.0 | 81.6 | 71.1 | 66 | 11 | 66.6 | 76.5 | 81.0 | 60 |
| 2 | 68.7 | 79.0 | 74.2 | 47 | 12 | 60.1 | 69.1 | 80.9 | 31 |
| 3 | 68.4 | 78.6 | 75.3 | 63 | 13 | 76.7 | 88.4 | 81.5 | 61 |
| 4 | 74.0 | 85.0 | 77.0 | 60 | 14 | 62.3 | 71.6 | 80.8 | 31 |
| 5 | 61.3 | 70.5 | 77.0 | 10 | 15* | 66.4 | 76.3 | 80.6 | 70 |
| 6 | 88.8 | 102.1 | 79.8 | 90 | 16 | 75.5 | 86.8 | 81.2 | 64 |
| 7 | 75.1 | 86.3 | 79.8 | 35 | 17 | 73.4 | 84.4 | 81.1 | 64 |
| 8* | 69.1 | 79.4 | 79.6 | 26 | 18 | 65.5 | 75.3 | 81.5 | 54 |
| 9 | 71.4 | 82.1 | 80.2 | 63 | 19 | 76.2 | 87.6 | 80.5 | 75 |
| 10 | 70.5 | 81.0 | 80.5 | 42 | 20 | 68.5 | 78.7 | 80.0 | 25 |
| 21 | 79.4 | 91.3 | 80.8 | 49 | 31 | 81.4 | 93.5 | 79.5 | 0 |
| 22* | 68.7 | 79.0 | 80.6 | 20 | 32 | 69.5 | 74.1 | 78.5 | 0 |
| 23 | 75.2 | 86.4 | 81.0 | 35 | 33 | 66.1 | 76.0 | 78.3 | 0 |
| 24 | 64.6 | 74.2 | 80.8 | 34 | 34* | 79.3 | 91.1 | 78.3 | 70 |
| 25 | 76.8 | 88.2 | 82.2 | 20 | 35 | 74.3 | 85.4 | 78.8 | 0 |
| 26* | 68.8 | 79.1 | 81.5 | 0 | 36 | 61.3 | 70.4 | 77.6 | 0 |
| 27* | 67.9 | 78.0 | 82.0 | 0 | 37 | 60.3 | 69.3 | 77.3 | 0 |
| 28 | 44.0 | 50.6 | 80.2 | 0 | 38 | 74.9 | 86.1 | 77.1 | 0 |
| 29 | 65.9 | 74.1 | 78.5 | 0 | 39 | 74.3 | 85.4 | 77.6 | 0 |
| 30 | 59.0 | 67.8 | 78.1 | 0 | 40 | 80.7 | 92.7 | 78.6 | 0 |
| 41* | 95.8 | 110.1 | 82.9 | 80 | 44 | 66.1 | 76.0 | 81.6 | 0 |
| 42 | 59.2 | 68.0 | 82.9 | 0 | 45 | 76.3 | 87.7 | 82.5 | 0 |

TABLE II-continued

| Day | Mg. Prod. (gms) | Cell Efficency (%) | Cell Eff. 14 Day Average (%) | Sludge (gms) | Day | Mg. Prod. (gms) | Cell Efficiency (%) | Cell Eff. 14 Day Average (%) | Sludge (gms) |
|---|---|---|---|---|---|---|---|---|---|
| 43 | 58.0 | 66.7 | 82.8 | 0 | 46 | 72.3 | 83.1 | 83.0 | 0 |

*Day of addition of $MoO_3$

EXAMPLE II 5200 gms of bath II were melted and the temperature was brought up to 700° C. Eight amperes of direct current were applied. Cell feed containing about 96% magnesium chloride was fed at a rate of about 320 gms per day. The bath was analyzed on the same schedule as the previous examples. The metal was dipped every other day.

1 gm of sodium tungstate was added after the cell had been operating for about 14 days. On each of the next six days, 1 gm of tungstate was added. Thence, 1 gm was added weekly. This is shown by Table III. The overall average for the cell efficiency was 78.88%.

TABLE III ($Na_2WO_4$ additive)

| Day | Mg Prod. (gms) | Cell Efficiency (%) | Cell Eff. 14 Day Average (%) |
|---|---|---|---|
| 1* | 137.5 | 79.0 | 63.8 |
| 2* | — | — | — |
| 3* | 143.7 | 82.6 | 70.8 |
| 4* | — | — | — |
| 5* | 112.0 | 64.4 | 73.0 |
| 6* | — | — | — |
| 7 | 126.2 | 72.5 | 73.3 |
| 9 | 144.0 | 82.7 | 76.4 |
| 11 | 125.0 | 71.8 | 75.8 |
| 13* | 166.6 | 95.7 | 78.4 |
| 15 | 146.2 | 84.0 | 79.1 |
| 17 | 154.4 | 88.7 | 80.0 |
| 19* | 160.0 | 92.0 | 83.9 |
| 21 | 129.0 | 74.1 | 84.1 |
| 23 | 135.5 | 77.9 | 83.4 |
| 25 | 159.0 | 91.3 | 86.3 |
| 27 | 130.5 | 75.0 | 83.3 |
| 29 | 127.0 | 73.0 | 81.7 |
| 31 | 135.0 | 77.6 | 80.1 |
| 33* | 123.0 | 70.7 | 77.1 |
| 35 | 139.0 | 79.9 | 77.9 |
| 37 | 157.5 | 90.5 | 79.7 |
| 39 | 167.5 | 96.3 | 80.4 |
| 41* | 151.5 | 87.1 | 82.1 |
| 43 | 158.5 | 91.1 | 84.7 |

*day of addition of $Na_2WO_4$

Control II 5200 gms of bath II were melted and the temperature was brought up to 700° C. Eight ampheres of direct current were applied. Cell feed containing about 96% magnesium chloride was fed at a rate of 320 to 355 gms a day (the higher figure at the higher production rates). The bath was analyzed as per the schedules in the other examples. The metal was dipped every other day.

1 gm of $K_2Cr_2O_7$ (potassium dichromate) was added after the cell had been operating for about 14 days. A similar amount was added at each of the intervals indicated by the asterisk in Table IV. The overall average for the cell efficiency was 72.06% which is below control I with no additives.

TABLE IV ($K_2Cr_2O_7$ additive)

| Day | Mg Prod. (gms) | Cell Eff. (%) | Cell Eff. 14 Day Average (%) |
|---|---|---|---|
| 1* | 135.6 | 77.9 | 70.7 |
| 3 | 127.8 | 73.4 | 69.6 |
| 5 | 126.3 | 72.6 | 69.6 |
| 7 | 117.5 | 67.5 | 70.1 |
| 9* | 148.5 | 85.3 | 71.3 |
| 11 | 140.0 | 80.5 | 76.0 |
| 13 | 114.0 | 65.5 | 74.2 |
| 15* | 118.0 | 67.8 | 73.4 |
| 17 | 115.0 | 66.1 | 62.2 |
| 19 | 142.5 | 81.9 | 73.5 |

*day of addition of $K_2Cr_2O_7$

EXAMPLE III

The procedure of Control II was repeated except that 1 gram of molybdenum oxide ($MoO_3$) was added to bath daily for 6 days and then at intervals as shown in Table V. The overall average for the cell efficiency was 80.19% which is vastly superior to the controls.

TABLE V ($MoO_3$ additive)

| Day | Mg Prod. (gms) | Cell Eff. (%) | Cell Eff. 14 Day Average (%) |
|---|---|---|---|
| 1* | 136.0 | 78.2 | 75.0 |
| 2* | — | — | — |
| 3* | 135.0 | 77.6 | 73.9 |
| 4* | — | — | — |
| 5* | 142.0 | 81.6 | 74.1 |
| 6* | — | — | — |
| 7 | 133.0 | 76.4 | 75.7 |
| 9 | 145.0 | 83.3 | 77.9 |
| 11 | 149.3 | 85.8 | 80.7 |
| 13 | 154.3 | 88.7 | 81.7 |
| 15* | 153.5 | 88.2 | 83.1 |
| 17 | 139.0 | 79.9 | 83.4 |
| 19 | 153.0 | 87.9 | 84.3 |
| 21 | 150.0 | 86.2 | 85.7 |
| 23* | 158.0 | 90.8 | 86.8 |

*day of addition of $MoO_3$

I claim:

1. A continuous method for the production of metallic magnesium by electrolytically decomposing magnesium chloride with a cathode and an anode in a molten salt bath comprising an alkali metal chloride and magnesium chloride the steps which comprise A. heating and fusing the salt bath at a temperature in the range from about 660° to about 900° C., B. passing direct current through said bath to decompose the magnesium chloride, maintaining a concentration of magnesium chloride in the salt bath in the range from about 5 to about 35 percent by weight by periodic additions thereof, D. adding periodically to the salt bath sufficient amounts of an additive selected from the group consisting of inorganic salts of molybdenum, inorganic salts of tungsten, metallic molybdenum, metallic tungsten or mixtures thereof which will coat the cathode surface with said metal and thereby increase the agglomeration of molten magnesium, and E. recovering molten magnesium from said salt bath.

2. The method as set forth in claim 1 wherein the additive is selected from the group consisting of tungsten oxides, tungsten halides, tungsten oxyhalides, ammonium tungstates, alkali metal tungstates, alkaline earth metal tungstates, molybdenum oxides, molybdenum halides, molybdenum oxyhalides, ammonium molybdates, alkali metal molybdates, alkaline earth metal molybdates or mixtures thereof.

3. The method as set forth in claim 1 wherein the cathode is mild steel and the anode is graphite.

4. The method as set forth in claim 1 wherein from about 100 to about 1000 parts per million of said additive is added periodically.

5. The method as set forth in claim 1 wherein an inorganic salt of molybdenum is added to the bath.

6. The method as set forth in claim 1 wherein an inorganic salt of tungsten is added to the bath.

7. The method as set forth in claim 5 wherein the inorganic salt is molybdenum trioxide.

8. The method as set forth in claim 6 wherein the inorganic salt is an alkali metal tungstate selected from the group consisting of sodium tungstate, potassium tungstate, or mixtures thereof.

* * * * *

UNITED STATES PATENT AND TRADEMARK OFFICE

CERTIFICATE OF CORRECTION

PATENT NO. : 4,073,704

DATED : Feb. 14, 1978

INVENTOR(S) : A. F. Beale

It is certified that error appears in the above-identified patent and that said Letters Patent are hereby corrected as shown below:

Column 3, line 4, under Bath I column; "18%" should be removed.

Column 3, line 4, under Bath II column; "18%" should be added.

Column 6, line 60 (Claim 1); should read -- C. maintaining a.....chloride in --.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*